US005490295A

United States Patent [19]

Boyd

[11] Patent Number: 5,490,295

[45] Date of Patent: Feb. 13, 1996

[54] WATER MATTRESS AND AIR MATTRESS CONSTRUCTION

[76] Inventor: Dennis Boyd, 14457 Rouge River, Chesterfield, Mo. 63017

[21] Appl. No.: 228,295

[22] Filed: Apr. 15, 1994

[51] Int. Cl.[6] ..... A47C 27/08

[52] U.S. Cl. ..... 5/451; 5/457

[58] Field of Search ..... 5/450, 451, 457, 5/458, 449

[56] References Cited

U.S. PATENT DOCUMENTS

| | | | |
|---|---|---|---|
| 3,522,123 | 7/1970 | Marchant | 5/458 X |
| 3,705,429 | 12/1972 | Nail | 5/457 |
| 4,280,235 | 7/1981 | Kowal | 5/458 |
| 4,328,599 | 5/1982 | Mollura | 5/458 X |
| 4,329,748 | 5/1982 | Finkelstein | 5/451 |
| 4,399,575 | 8/1983 | Hall | 5/450 |
| 4,551,873 | 11/1985 | Hall | 5/450 |
| 4,751,757 | 6/1988 | Moreno | 5/450 |
| 4,905,331 | 3/1990 | Hochschild, III | 5/450 |
| 4,965,899 | 10/1990 | Sekido et al. | 5/457 X |
| 5,086,528 | 2/1992 | Miller | 5/451 |
| 5,222,262 | 6/1993 | Boyd | 5/451 |

*Primary Examiner*—Michael F. Trettel

*Attorney, Agent, or Firm*—Polster, Lieder, Woodruff & Lucchesi

[57] ABSTRACT

A water mattress includes a closeable vinyl envelope for receiving water, the vinyl envelope having a top, a bottom, and a plurality of sides, the sides being disposed in opposing pairs. A plurality of double-walled members extend from the top to the bottom of the envelope inside the cavity. Each double-walled member has a top connecting web extending across the top thereof and two walls depending from the connecting web, the connecting web being secured to the top of the envelope. Each double-walled member is also secured to the bottom of the envelope and extends longitudinally substantially from one side of the envelope to the opposing side of the envelope. It is preferred that each double walled member wall include an intermediate elastic section so that each of the double walls may stretch to a limited extent when force is applied thereto by water in the mattress. A pneumatic mattress of similar construction is also disclosed.

12 Claims, 3 Drawing Sheets

WATER MATTRESS AND AIR MATTRESS CONSTRUCTION

BACKGROUND OF THE INVENTION

This invention relates to waterbed mattresses and to pneumatic mattresses, and more particularly to an improved interior construction of same.

Waterbed mattresses are known to provide many advantages in terms of comfort and restfulness. More recently, improved pneumatic mattresses have also been available with some of the comfort advantages of waterbed mattresses. These various mattresses, however, could be improved. For example, many such mattresses consist of a vinyl envelope with the interior cavity thereof substantially open. Such mattresses are subject to considerable bowing since the top and bottom of the mattress are connected together only at the sides of the mattress. In addition, undesirable wave action can result with such mattresses when a user moves about on the mattress.

Various damping mechanisms have been proposed to deal with the wave action problem, but these can be fairly complex and expensive. Similarly, at least one mattress has been designed with a plurality of extruded plastic walls extending from the top to the bottom of the mattress, but that design can be improved as well. For example, although the interior wall construction does tend to prevent bowing, the seams of these individual walls where they are connected to the top and bottom of the mattress tend to separate because of the forces involved. In addition, the anti-bowing walls are made of a fairly rigid material which tends to be uncomfortable to the user and result in a mattress which is rigidly constrained in terms of the maximum permissible bowing. Applied forces which attempt to exceed the maximum bowing allowed by the interior anti-bowing walls place extreme stress on the seams.

SUMMARY OF THE INVENTION

Among the various objects and features of the present invention may be noted the provision of an improved mattress construction.

Another object is the provision of such a mattress with better sealing characteristics.

A third object is the provision of such a mattress which reduces stress on the interior seams of the mattress.

A fourth object is the provision of such a mattress with improved comfort.

A fifth object is the provision of such a mattress with reduced motion.

A sixth object is the provision of such a mattress which not only satisfactorily addressing the problem of bowing but also overcomes the problems inherent when excessive forces are applied to the interior of the mattress.

Other objects and features will be in part apparent and in part pointed out hereinafter.

Briefly, a mattress of the present invention includes a closeable vinyl envelope having a top, a bottom, and a plurality of sides, the sides being disposed in opposing pairs. The mattress also includes at least one double-walled member extending from the top to the bottom of the envelope inside the cavity. The double-walled member has a top connecting web extending across the top thereof and two walls depending from the top connecting web. The top connecting web is secured to the top of the envelope. The double-walled member is also secured to the bottom of the envelope and extends longitudinally substantially from one side of the envelope to the opposing side of the envelope.

BRIEF DESCRIPTION OF THE DRAWINGS

Similar reference characters indicate similar parts throughout the several views of the drawings.

DESCRIPTION OF THE PREFERRED EMBODIMENTS

Figure 1:
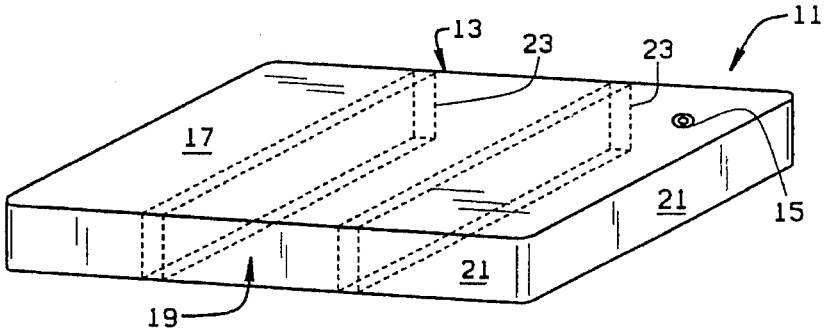
FIG. 1 is a perspective view of the mattress of the present invention.

Turning now to the drawings, a mattress 11 of the present invention is particularly suitable for use as a water mattress or as a pneumatic mattress. For convenience, it will be described as a water mattress, although those skilled in the art will understand the minor modifications necessary to use the mattress as a pneumatic mattress. Mattress 11 includes a conventional closeable vinyl envelope 13 defining a cavity for receiving water through a suitable valve 15. Envelope 13 has a top 17, a bottom 19, and a plurality of sides 21, the sides being disposed in opposing pairs. All this construction is, of course, conventional.

Mattress 11 also includes a plurality of double-walled anti-bowing members 23 extending from the top to the bottom of the envelope inside the cavity. Although two such anti-bowing members are shown, as few as one or as many as desired could be used. For example, anti-bowing members could be spaced at a convenience spacing such as seven inches center-to-center throughout the mattress. This spacing is significantly larger than the width of the anti-bowing members, which may measure only one inch (for example) from side to side. It is preferred that the anti-bowing members be disposed perpendicular to the longitudinal axis of mattress 11 as shown in FIG. 1 for purposes of added comfort and to reduce wave motion in the mattress, and that they extend (along the members' longitudinal axes) substantially from one side of the mattress to the other (also as shown in FIG. 1).

Anti-bowing member 23 may have various constructions, as discussed hereinafter, but it is preferred to have a double wall. For example, in its simplest form (illustrated in FIG. 2) anti-bowing member consists of a vinyl sheet of material having two downwardly depending walls 25, a top connecting web 27 suitably secured to mattress top 17 by heat sealing or the like, and a bottom connecting web 29, suitably secured to mattress bottom 19 by heat sealing or the like. The top and bottom connecting webs are, as shown, approximately the same size. The use of the same vinyl material to form anti-bowing members 23 as make up top 17 and bottom 19 of the envelope has several advantages. For example, a superior dielectric seal can be achieved between the members and the envelope since the materials are identical. In addition, the fact that manufacturers are accustomed to working with such vinyl provides added manufacturing advantages. Moreover, the double wall construction with the connecting webs reduces the seam stress on each vertical wall.

Figure 2:
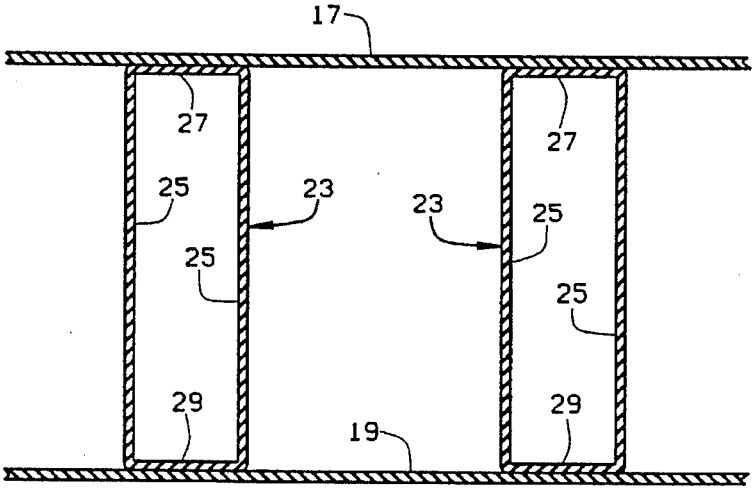
FIG. 2 is a cross-sectional view on an enlarged scale of a portion of the mattress of FIG. 1.

As can be seen from FIG. 2, top connecting web 4 defines the spacing between walls 25. That spacing is a matter of choice, but preferably is approximately one inch.

Figure 3:
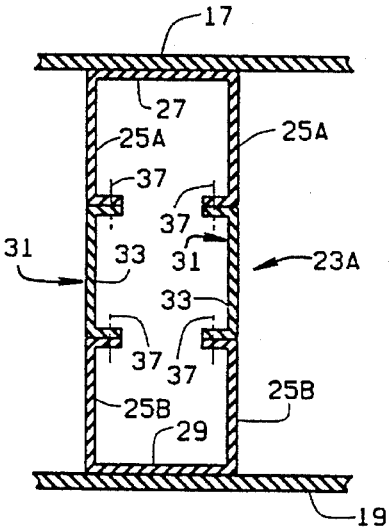
FIG. 3 is a view similar to FIG. 2 showing an alternative embodiment.
Figure 4:
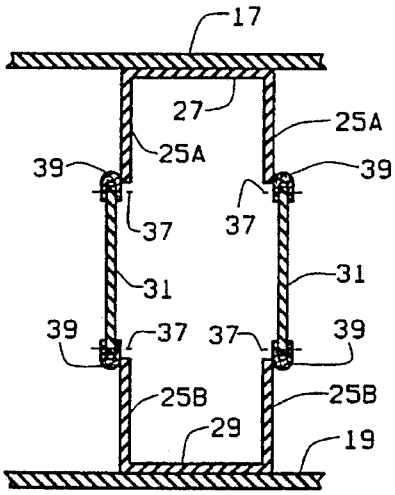
FIG. 4 is a view similar to FIG. 3 showing another alternative embodiment.

Although the construction of anti-bowing member 23 shown in FIG. 2 is the simplest it is not the only possible construction or even, for some applications, the best. For example, turning to FIG. 3, vinyl top connecting web 27 in the embodiment labelled 23A has a pair of depending walls 25A, while bottom connecting web 29 has a pair of upwardly depending walls 25B. In the embodiment of FIG. 2, of course, these walls 25A and 25B are integral, but in the embodiment of FIG. 3 they are connected together by an intermediate member 31, consisting of a pair of elastic fabric panels 33. Elastic fabric panels 33 are connected to upper walls 25A and lower walls 25B in a suitable manner such as stitching indicated at 37. An alternative to this method of attachment is shown in FIG. 4 in which a set of vinyl caps 39 are stitched to elastic panel 33 as shown and the caps are then heat sealed to the upper walls 25A and lower walls 25B Elastic panels 33 are made of any suitable material capable of withstanding the environment in a waterbed. For example, latex rubber based elastic fabrics such as are used in ace bandages are known to stand up well to water and temperature. In addition, stretch fabrics using a synthetic rubber such as lycra (from DuPont), are used in swimwear and are suitable for use in the present invention.

Figure 5:
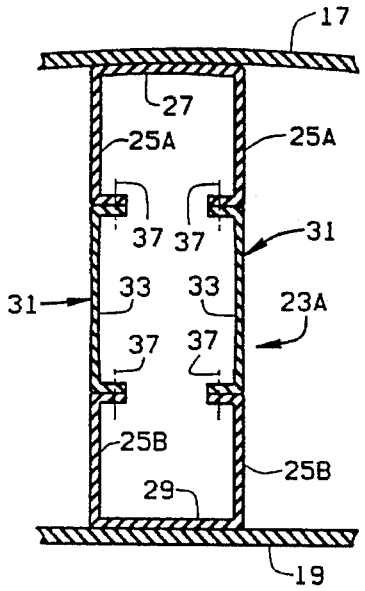
FIG. 5 is a view showing the effect of the application of force to the top of the mattress using the embodiment of FIG. 3.

As shown in FIG. 5, when excess pressure forces the top 17 of envelope 13 upwardly, anti-bowing member 31 stretches to accommodate the force, while vinyl walls 25A and 25B remain the same relative length. This reduces the amount of force that would otherwise be applied to the heat seams connecting the member 23A to the top and bottom of the envelope, thereby protecting the seams.

Figure 6:
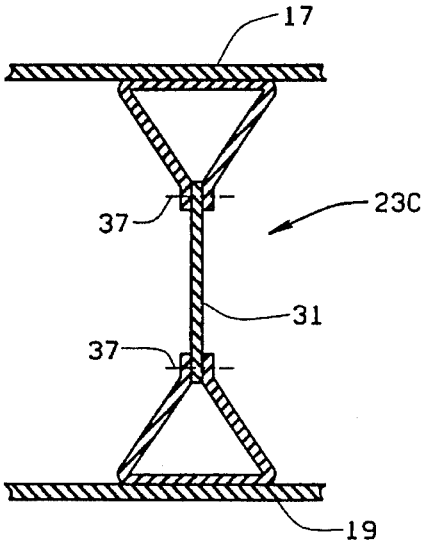
FIG. 6 is a view similar to FIG. 3 showing a further embodiment.

Another alternative construction of anti-bowing member 23 is labelled 23C in FIG. 6. In this embodiment the intermediate elastic layer is formed of a single sheet 31 rather than a pair of walls 31. The upper walls 25A and lower walls 25B are stitched to sheet 31 in this embodiment as shown. Other suitable means of connection could also be used.

Figure 7:
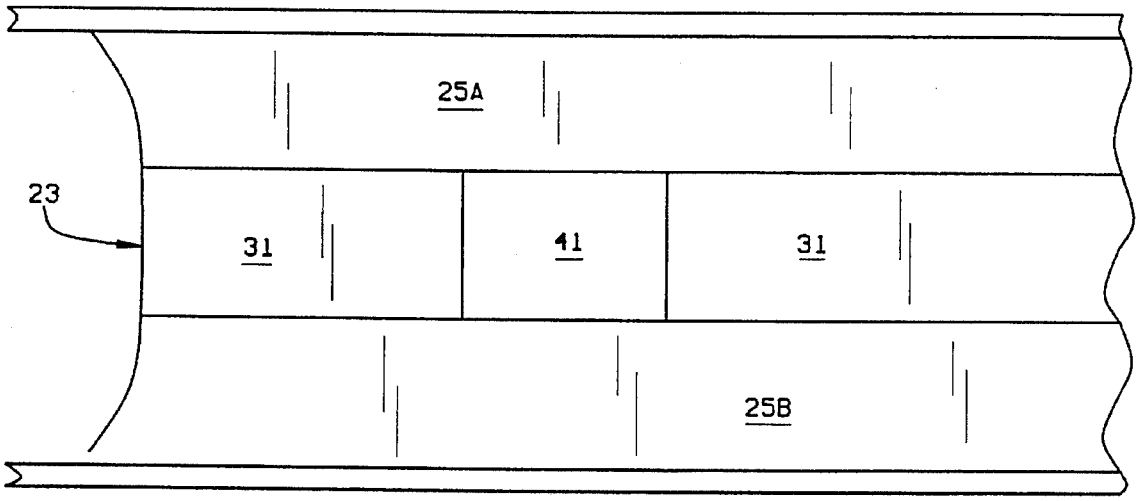
FIG. 7 is a side view of the interior of one embodiment of the mattress of FIG. 1.
Figure 8:
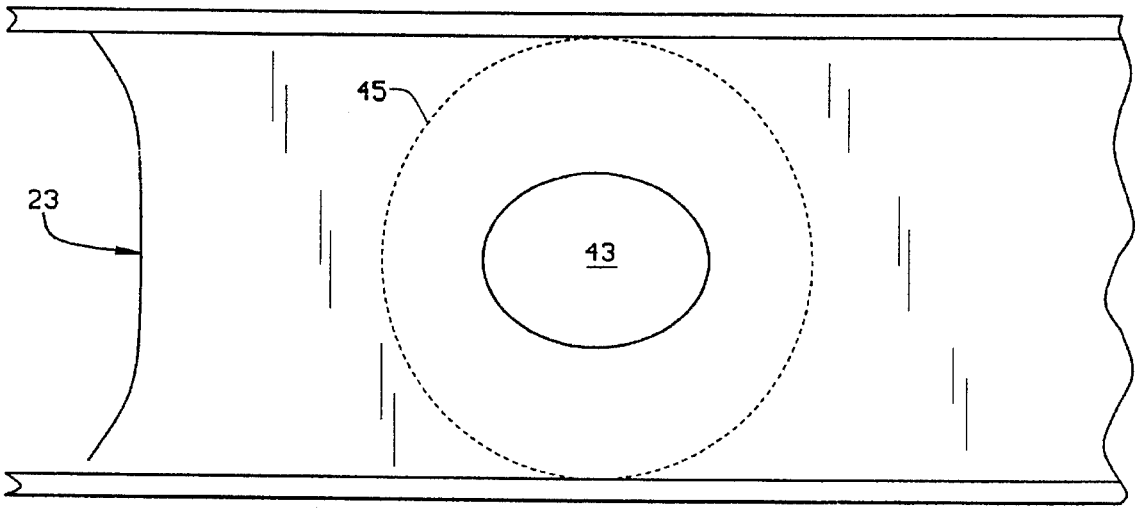
FIG. 8 is a view similar to FIG. 7 illustrating another embodiment.

No matter what the construction of anti-bowing member 23, it is preferred that gaps, such as the rectangular gap 41 shown in FIG. 7 or the circular gap 43 shown in FIG. 8, or the larger circular gap 45 shown in phantom in FIG. 8 be provided to permit some fluid to flow between the various sections of the mattress defined by members 23. This facilitates filling of the mattress and prevents burping. In the example shown in FIG. 7, the upper walls 25A and the lower walls 25B extend substantially the entire width of the mattress, while the flexible walls 33 have periodic gaps. In the example shown in FIG. 8, the two walls of the member 23 have corresponding holes therethrough. Various combinations of gaps and other holes in members 23 could, of course, be used as desired.

Figure 9:
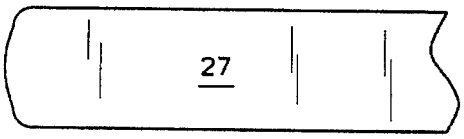
FIG. 9 is a top view of an anti-bowing member used in the mattress of FIG. 1.

It is preferred as shown in FIGS. 7 and 8, that the end of each connecting member be arched as shown, and (as shown in FIG. 9) that the ends of the connecting members be rounded on their tops.

Figure 10:
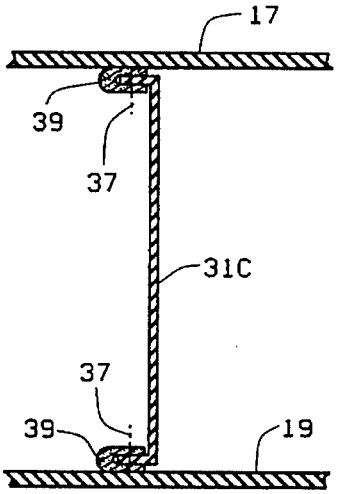
FIG. 10 is a view similar to FIG. 3 showing yet another embodiment.

Turning to FIG. 10, it can be seen that elastic sheet 31, labelled 31C in FIG. 10, can be selected to have a greater length than that shown in previous figures so that it extends substantially from the top to the bottom of the mattress envelope. The top and bottom of elastic sheet or member 31C are captured by suitable stitching 37 in vinyl caps 39 and the vinyl caps are in turn suitably secured as by heat sealing to the top and bottom of the mattress.

In view of the above, it will be seen that the various objects and features of the present invention are achieved and other advantageous results obtained. Numerous variations of the present invention are contemplated, so that the embodiments described herein are intended to be illustrative only and not to be taken in a limiting sense.

What is claimed is:

1. A water mattress comprising;

a closeable vinyl envelope defining a cavity for receiving water, said vinyl envelope having a top, a bottom, and a plurality of sides, the sides being disposed in opposing pairs;

at least one double-walled member extending from the top to the bottom of the envelope inside the cavity, said double-walled member having a top connecting web extending across the top thereof and two walls depending from said connecting web, said connecting web being secured to the top of the envelope, said double-walled member also being secured to the bottom of the envelope and extending longitudinally substantially from one side of the envelope to the opposing side of the envelope; said double-walled member also including a bottom connecting web and two walls extending upwardly from the bottom connecting web, the bottom connecting web being secured to the bottom of the envelope;

wherein the two walls depending from the top connecting web are connected to the two walls extending upwardly from the bottom connecting web by a separate intermediate member.

2. The water mattress as set forth in claim 1 wherein the separate intermediate member is formed of an stretchable, elastic material.

3. The water mattress as set forth in claim 1 wherein the separate intermediate member is single-walled.

4. The water mattress as set forth in claim 1 wherein the separate intermediate member is double-walled such that each wall depending from the top connecting web is connected to a corresponding wall extending upwardly from the bottom connecting web by a corresponding wall of the separate intermediate member.

5. The water mattress as set forth in claim 4 wherein each wall of the separate intermediate member is connected to its corresponding wall depending from the top connecting web and to its corresponding wall extending upwardly from the bottom connecting web by suitable stitching.

6. The water mattress as set forth in claim 1 wherein the separate intermediate member is formed from a rubberized material.

7. A pneumatic mattress comprising:

a closeable vinyl envelope for receiving air for inflation of the mattress, said vinyl envelope having a top, a bottom, and a plurality of sides, the sides being disposed in opposing pairs;

at least one double-walled member extending from the top to the bottom of the envelope inside the cavity, said double-walled member having a top connecting web extending across the top thereof and two walls depending from said connecting web, said connecting web being secured to the top of the envelope, said double-walled member also being secured to the bottom of the envelope and extending longitudinally substantially from one side of the envelope to the opposing side of the envelope; said double walled member also including a bottom connecting web and two walls extending upwardly from the bottom connecting web, the bottom connecting web being secured to the bottom of the envelope;

wherein the two walls depending from the top connecting web are connected to the two walls extending upwardly from the bottom connecting web by a separate intermediate member.

8. The pneumatic mattress as set forth in claim 7 wherein the separate intermediate member is formed of an stretchable, elastic material.

9. The pneumatic mattress as set forth in claim 7 wherein the separate intermediate member is single-walled.

10. The pneumatic mattress as set forth in claim 7 wherein the separate intermediate member is double-walled such that each wall depending from the top connecting web is connected to a corresponding wall extending upwardly from the bottom connecting web by a corresponding wall of the separate intermediate member.

11. The pneumatic mattress as set forth in claim 10 wherein each wall of the separate intermediate member is connected to its corresponding wall depending from the top connecting web and to its corresponding wall extending upwardly from the bottom connecting web by suitable stitching.

12. The pneumatic mattress as set forth in claim 7 wherein the separate intermediate member is formed from a rubberized material.

* * * * *